US008368598B2

(12) United States Patent
Kuo et al.

(10) Patent No.: US 8,368,598 B2
(45) Date of Patent: Feb. 5, 2013

(54) MULTIBAND ANTENNA

(75) Inventors: Chang-Hsin Kuo, Tu-Cheng (TW); Shih-Tsung Kan, Tu-Cheng (TW)

(73) Assignee: Chi Mei Communication Systems, Inc., New Taipei (TW)

( * ) Notice: Subject to any disclaimer, the term of this patent is extended or adjusted under 35 U.S.C. 154(b) by 368 days.

(21) Appl. No.: 12/784,504

(22) Filed: May 21, 2010

(65) Prior Publication Data

US 2011/0193748 A1 Aug. 11, 2011

(30) Foreign Application Priority Data

Feb. 5, 2010 (TW) ..... 99103514

(51) Int. Cl.
*H01Q 1/38* (2006.01)

(52) U.S. Cl. ..... 343/700 MS; 343/702

(58) Field of Classification Search ..... 343/700 MS, 343/702
See application file for complete search history.

(56) References Cited

U.S. PATENT DOCUMENTS

| | | | | |
|---|---|---|---|---|
| 7,362,277 | B2 * | 4/2008 | Su | 343/702 |
| 8,188,925 | B2 * | 5/2012 | DeJean | 343/700 MS |
| 2002/0175866 | A1 * | 11/2002 | Gram | 343/702 |
| 2007/0247372 | A1 * | 10/2007 | Huang | 343/700 MS |

* cited by examiner

*Primary Examiner* — Tan Ho
(74) *Attorney, Agent, or Firm* — Altis Law Group, Inc.

(57) ABSTRACT

A multiband antenna used for a portable communication device includes a first antenna unit, a second antenna unit, a third antenna unit, and feed member. The first antenna unit, the second antenna unit and the third antenna unit are capable of receiving and/or sending wireless signals. The second antenna unit is connected to the first antenna unit, the third antenna unit is connected to the first antenna unit, and the feed member is electrically connected to the first antenna unit and the second antenna unit. The feed member receives wireless signals and transmits the wireless signals through the first antenna, the second antenna unit and the third antenna unit to generate corresponding current paths, and the first antenna unit is located between the second antenna unit and the third antenna unit to isolate the second antenna unit and the third antenna unit to avoid coupling interference of their resonant frequencies.

18 Claims, 3 Drawing Sheets

MULTIBAND ANTENNA

BACKGROUND

1. Technical Field

The disclosure generally relates to antennas, particularly to, to a multiband antenna for use in a portable communication device.

2. Description of the Related Art

Antennas are used in mobile phones, personal digital assistants (PDAs), and other portable communication device to receive and/or send wireless signals. Commonly, a portable communication device may receive and/or send wireless signals of different frequencies, which require its antenna to be a multiband antenna. Generally, the multiband antennas achieve multiband frequencies by the coupling effect and the parasitic effect.

However, many multiband antennas have complicated structures and are large in size, making it difficult to miniaturize the portable communication devices. Moreover, coupling effects among different current paths may affect their own operating frequencies of each current path. Therefore, it is difficult for the multiband antenna to have independent and non-interfering resonant frequencies. It can also be difficult to adjust the bandwidths of the independent operating frequencies.

Therefore, there is room for improvement within the art.

BRIEF DESCRIPTION OF THE DRAWINGS

Many aspects of an exemplary multiband antenna employing the same can be better understood with reference to the following drawings. The components in the drawings are not necessarily drawn to scale, the emphasis instead being placed upon clearly illustrating the principles of the exemplary multiband antenna. Moreover, in the drawings, like reference numerals designate corresponding parts throughout the several views. Wherever possible, the same reference numbers are used throughout the drawings to refer to the same or like elements of an embodiment.

DETAILED DESCRIPTION

Figure 1:
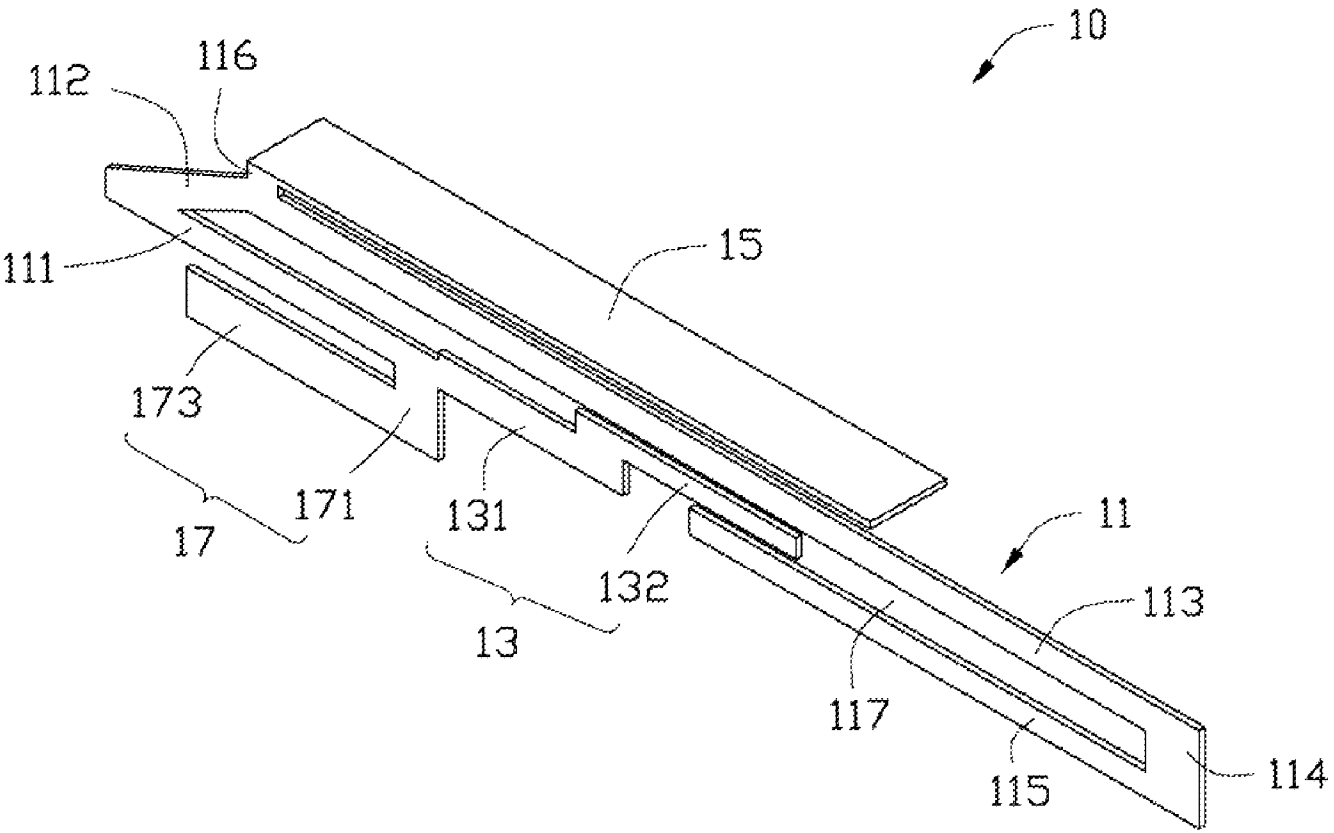
FIG. 1 is a schematic view of a multiband antenna, according to an exemplary embodiment.
Figure 2:
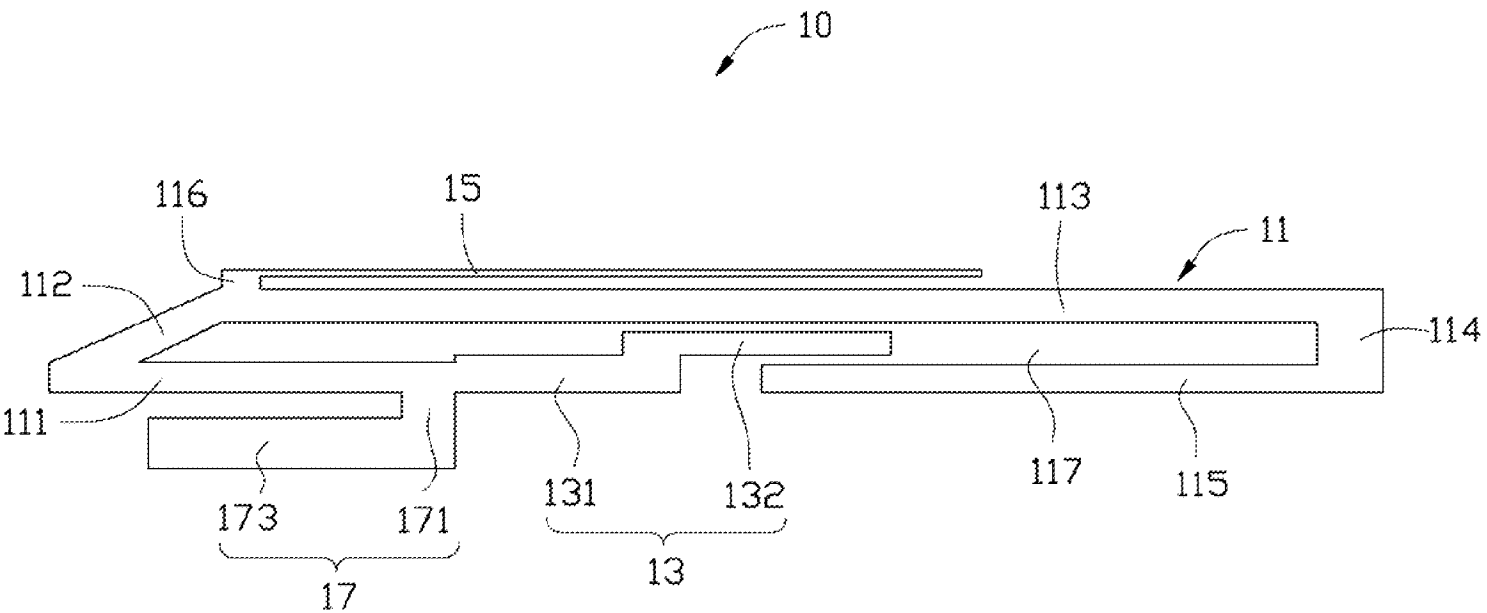
FIG. 2 is a schematic view of the multiband antenna shown in FIG. 1, from another angle.

FIGS. 1 and 2 schematically show an exemplary embodiment of a multiband antenna 10 for use in a portable communication device, such as a mobile phone or a PDA for receiving and/or sending wireless signals.

The multiband antenna 10 is made of conductive materials, such as copper or other metals. The multiband antenna 10 includes a first antenna unit 11, a second antenna unit 13, a third antenna unit 15, and a feed member 17, all of which can be substantially flat sheets. The first antenna unit 11 is connected to the second antenna unit 13, the third antenna 15, and the feed member 17 cooperatively. The first antenna unit 11, the second antenna unit 13 and the feed member 17 are coplanar, and the third antenna unit 15 is substantially perpendicularly connected to the first antenna unit 11, namely, the third antenna unit 15 is substantially perpendicular to the plane of the first antenna unit 11.

The first antenna unit 11 includes a first radiating member 111, a second radiating member 112, a third radiating member 113, a fourth radiating member 114, a fifth radiating member 115, and a connection member 116, which are substantially flat strip sheets. The second radiating member 112 is connected to an end of the first radiating member 111, forming an angle less than 90° with the first radiating member 111. An end of the third radiating member 113 is connected to the second radiating member 112 opposite to the end connected to the first radiating member 111. The other end of the third radiating member 113 is substantially perpendicularly connected to the fourth radiating member 114. The second radiating member 112 and the fourth radiating member 114 are located on the same side of the third radiating member 113.

The third radiating member 113 is substantially parallel to the fifth radiating member 115 and an end of the fifth radiating member 115 is substantially perpendicularly connected to the fourth radiating member 114. The fifth radiating member 115 and the first radiating member 111 are aligned with each other and are spaced from each other. Thus, the first radiating member 111 and the fifth radiating member 115 are on substantially the same extended line. The connection member 116 is adjacent to the second radiating member 112 and is connected between the third radiating member 113 and the third antenna unit 15. The third radiating member 113 and the fifth radiating member 115 are respectively connected to opposite sides of the fourth radiating member 114 to cooperatively define a slot 117.

The second antenna unit 13 includes a first sheet body 131 connected to a second sheet body 132. The first sheet body 131 and the second sheet body 132 are substantially flat strip sheets. The width of the first sheet body 131 is slight larger than the width of the first radiating member 111. The first sheet body 131 is connected to the distal end of the first radiating member 111 and is spaced from the fifth radiating member 115. The first sheet body 131 is substantially parallel to the third radiating member 113 and is aligned with the fifth radiating member 115. The outer edge (namely, the lateral side away from the third radiating member 113) of the first sheet body 131 is respectively aligned with the outer edge of the first radiating member 111 and the fifth radiating member 115.

The second sheet body 132 is partially connected to the inner edge (namely, the lateral side facing toward the third radiating member 113) of the first sheet body 131 and is substantially parallel to the third radiating member 113. The second sheet body 132 is aligned with the fourth radiating member 114 and is partially received in the slot 117.

The third antenna unit 15 is substantially a flat sheet and has an end substantially perpendicularly connected to the connection member 116. The remaining part of the third antenna unit 15 is spaced from the third radiating member 113. Two long sides of the third antenna unit 15 are substantially parallel to the third radiating member 113. The length of the third antenna 15 is less than the length of the third radiating member 113.

The feed member 17 is a substantially "L" shaped flat sheet and includes a connecting arm 171 and a feed arm 173. The first radiating member 111 and the feed arm 173 are substantially perpendicularly connected to the opposite ends of the connecting arm 171, respectively, and the connecting arm 171 is substantially adjacent to the first sheet body 131. The feed arm 173 is a substantially strip flat sheet and is substantially parallel to the first radiating member 111. In this exemplary embodiment, the opposite the ends of the feed arm 173 can be respectively defined as a signal feeding end and a grounding end. The signal feeding end is connected to the connecting arm 171 and is electrically connected to a corresponding signal transmitting portion on a circuit board (not shown) for receiving and/or sending wireless signals. The grounding end opposite the signal feeding end is electrically connected to ground portion on the circuit board.

In communication, the signal feeding end of the feed arm 173 receives the wireless signals and transmits the wireless signals through the first antenna unit 11, the second antenna unit 13, and the third antenna unit 15 to generate corresponding current paths, resulting in different resonant frequencies. In use, the resonant frequency range of the first antenna unit 11 is about 824 MHz-894 MHz, and used to receive and/or send global system for mobile communication (GSM) wireless signals. The resonant frequency range of the second antenna unit 13 is about 1850 MHz-1990 MHz, and used to receive and/or send personal communication services (PCS) wireless signals. The resonant frequency range of the third antenna unit 15 is about 1570 MHz-1580 MHz, and used to receive and/or send global positioning system (GPS) wireless signals. One skilled in the art would know how to size the various antennas to create these resonant frequency ranges.

Further referring to FIGS. 1 and 2, the first antenna unit 11 is located between the second antenna unit 13 and the third antenna unit 15, and the first antenna unit 11 forms a low frequency radiating area, the second antenna unit 13 and the third antenna 15 respectively form a high frequency radiating area. Thereby, in actual use, the low frequency radiating area is formed between the two high frequency radiating areas and is capable of isolating the two high frequency radiating areas to avoid mutual coupling between high frequencies of the second antenna unit 13 and the third antenna 15. Thus, the first antenna unit 11, the second antenna unit 13 and the third antenna 15 respectively have an independent and non-interfering resonant frequencies, and are capable of adjusting the bandwidths of the independent operating frequencies.

Figure 3:
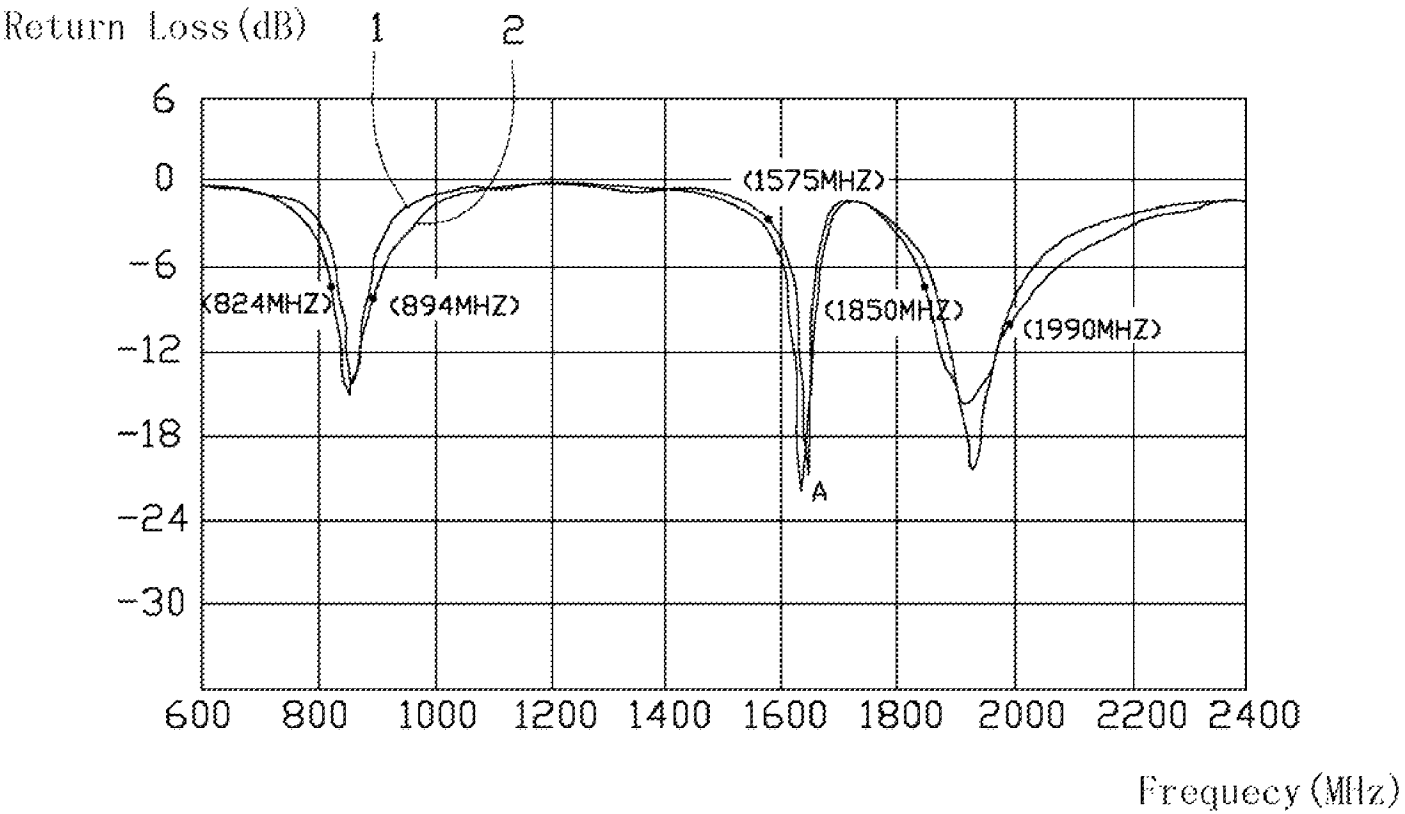
FIG. 3 is an optimum test diagram of measuring a return loss (RL) of the multiband antenna shown in FIG. 1 used in a portable communication device, in different working frequencies.

FIG. 3 shows an exemplary test diagram when the multiband antenna 10 is used in the slide-type mobile phone, disclosing return loss (RL) varying with frequency. The horizontal axis of the test diagram is expressed as the frequency, and the vertical axis of the test diagram is expressed as the return loss. Among them, curve 1 represents the return loss curve of the multiband antenna 10 when the slide-type mobile phone is in a closed state, and curve 2 represents the return loss curve of the multiband antenna 10 when the slide-type mobile phone is in an open state.

In this exemplary embodiment, during testing, all the return losses are less than −6 decibels (dBs) in the frequency band 824 MHz-894 MHz and the frequency band 1850 MHz-1990 MHz, which has better radiating efficiency. In actual use, the resonance point A of the GPS frequency band 1570 MHz-1580 MHz may shift to the low frequency band, so the multiband antenna 10 also has better radiating efficiency between 1570 MHz-1580 MHz of the GPS frequency band.

In summary, in the multiband antenna 10 of the exemplary embodiment. The first antenna unit 11 of the multiband antenna 10 is positioned between the second antenna unit 13 and the third antenna unit 15 to isolate the second antenna unit 13 and the third antenna 15, avoiding mutual coupling between high frequencies of the second antenna unit 13 and the third antenna unit 15. Thus, the first antenna unit 11, the second antenna unit 13 and the third antenna unit 15 respectively have their own independent and non-interfering operating frequencies such that the bandwidths of the multiband antenna 10 can be adjusted independently. Moreover, the multiband antenna 10 has simple design structure, and its different operating frequencies also do not couple with each other, thus, the multiband antenna 10 can be applied to different kinds of wireless communication systems/devices.

It is to be understood, however, that even though numerous characteristics and advantages of the exemplary disclosure have been set forth in the foregoing description, together with details of the structure and function of the exemplary disclosure, the disclosure is illustrative only, and changes may be made in detail, especially in matters of shape, size, and arrangement of parts within the principles of exemplary disclosure to the full extent indicated by the broad general meaning of the terms in which the appended claims are expressed.

What is claimed is:

1. A multiband antenna for a portable communication device, comprising:

a first antenna unit for receiving and/or sending wireless signals;

a second antenna unit connected to the first antenna unit for receiving and/or sending wireless signals;

a third antenna unit connected to the first antenna unit for receiving and/or sending wireless signals; and a feed member electrically connected to the first antenna unit and the second antenna unit, wherein the feed member receives wireless signals and transmits the wireless signals through the first antenna, the second antenna unit and the third antenna unit to generate corresponding current paths, and the first antenna unit is located between the second antenna unit and the third antenna unit to isolate the second antenna unit and the third antenna unit to avoid coupling interference of their resonant frequencies; the first antenna unit, the second antenna unit and the feed member are coplanar, and the third antenna unit is perpendicular to the plane of the first antenna unit.

2. The multiband antenna as claimed in claim 1, wherein the first antenna unit is capable of generating a low frequency current path and comprises a first radiating member and a second radiating member, the second radiating member is connected to an end of the first radiating member, forming an angle less than 90° with the first radiating member.

3. The multiband antenna as claimed in claim 2, wherein the first antenna unit further comprises a third radiating member and a fourth radiating member, an end of the third radiating member is connected to the second radiating member, another end is perpendicularly connected to the fourth radiating member, and the second radiating member and the fourth radiating member are located on two opposite ends of the third radiating member.

4. The multiband antenna as claimed in claim 3, wherein the first antenna unit further comprises a fifth radiating member, the third radiating member is parallel to the fifth radiating member and an end of the fifth radiating member is perpendicularly connected to the fourth radiating member, the fifth radiating member and the first radiating member are aligned with each other and are spaced form each other, and the first radiating member and the fifth radiating member are on the same extended line.

5. The multiband antenna as claimed in claim 4, wherein the first antenna unit further comprises a connection member adjacent to the second radiating member, the connection member is connected between the third radiating member and the third antenna unit, and the third radiating member and the fifth radiating member are respectively connected to opposite sides of the fourth radiating member to form a slot.

6. The multiband antenna as claimed in claim 5, wherein the second antenna unit is capable of generating a high frequency current path and comprises a first sheet body and a second sheet body connected to the first sheet body, the width of the first sheet body is larger than the width of the first radiating member, and the first sheet body is connected to the distal end of the first radiating member and is spaced from the fifth radiating member.

7. The multiband antenna as claimed in claim 6, wherein the first sheet body is parallel to the third radiating member and is aligned with the fifth radiating member, the outer edge of the first sheet body is respectively aligned with the outer edge of the first radiating member and the fifth radiating member.

8. The multiband antenna as claimed in claim 6, wherein the second sheet body is partially connected to the inner edge of the first sheet body and is parallel to the third radiating member, and the second sheet body is aligned with the fourth radiating member and is partially received in the slot.

9. The multiband antenna as claimed in claim 5, wherein the third antenna unit is capable of generating a high frequency current path and is a flat sheet, an end of the third antenna unit is perpendicularly connected to the connection member, the remaining part of the third antenna unit is spaced from the third radiating member, and the length of the third antenna is less than the length of the third radiating member.

10. The multiband antenna as claimed in claim 1, wherein the feed member is an "L" shaped flat sheet and includes a connecting arm and a feed arm, the connecting arm is connected to the first radiating member, an end of the feed arm is connected to the connecting arm and is capable of receiving and/or sending wireless signal, and another end of the feed arm is capable of is electrically connected to ground.

11. A multiband antenna for a portable communication device, comprising:

a first antenna unit for receiving and/or sending wireless signals and generating a low resonant frequency;

a second antenna unit connected to the first antenna unit for receiving and/or sending wireless signals and generating a high resonant frequency;

a third antenna unit connected to the first antenna unit and for receiving and/or sending wireless signals and generating a high resonant frequency; and a feed member electrically connected to the first antenna unit and the second antenna unit and for receiving wireless signals, wherein the second antenna unit and the third antenna unit are respectively connected to opposite sides of the first antenna unit, the feed member transmits the wireless signal through the first antenna unit, the second antenna unit and the third antenna unit, and the first antenna unit is capable of isolating the second antenna unit and the third antenna unit to avoid coupling interference of the two high resonant frequencies of the second antenna unit and the third antenna unit, the first antenna unit is capable of generating a low frequency current path and comprises a first radiating member, a second radiating member, a third radiating member, a fourth radiating member, a fifth radiating member, and a connection member, the first radiating member, the second radiating member, the third radiating member, the fourth radiating member, and the fifth radiating member are connected in series, and the connection member is adjacent to the second radiating member and is connected between the third radiating member and the third antenna unit.

12. The multiband antenna as claimed in claim 11, wherein the second radiating member is connected to the first radiating member, forming an angle less than 90° with the first radiating member, the third radiating member is connected to the second radiating member, another end of the third radiating member is perpendicularly connected to the fourth radiating member, and the second radiating member and the fourth radiating member are located on two opposite ends of the third radiating member.

13. The multiband antenna as claimed in claim 12, wherein the third radiating member is parallel to the fifth radiating member and the fifth radiating member is perpendicularly connected to the fourth radiating member, the fifth radiating member and the first radiating member are aligned and spaced from each other, the first radiating member and the fifth radiating member are on the same extended line, and the third radiating member and the fifth radiating member are respectively connected to opposite sides of the fourth radiating member to form a slot.

14. The multiband antenna as claimed in claim 11, wherein the second antenna unit is capable of generating a high frequency current path and comprises a first sheet body and a second sheet body connected to the first sheet body, the width of the first sheet body is larger than the width of the first radiating member, and the first sheet body is connected to the distal end of the first radiating member and is spaced from the fifth radiating member.

15. The multiband antenna as claimed in claim 14, wherein the first sheet body is parallel to the third radiating member and is aligned with the fifth radiating member, the second sheet body is parallel to the third radiating member and is aligned with the fourth radiating member and is partially received in the slot.

16. The multiband antenna as claimed in claim 14, wherein the third antenna unit is capable of generating a high frequency current path and is a flat sheet, an end of the third antenna unit is perpendicularly connected to the connection member, the remaining part of the third antenna unit is spaced from the third radiating member, and the length of the third antenna unit is less than the length of the third radiating member.

17. The multiband antenna as claimed in claim 11, wherein the feed member is "L" shaped flat sheet and includes a connecting arm and a feed arm, the connecting arm is connected to the first radiating member, an end of the feed arm is connected to the connecting arm and is capable of receiving and/or sending wireless signal, and another end of the feed arm is capable of is electrically connected to ground.

18. A multiband antenna for a portable communication device, comprising:

a first antenna unit for receiving and/or sending wireless signals;

a second antenna unit connected to the first antenna unit for receiving and/or sending wireless signals;

a third antenna unit connected to the first antenna unit for receiving and/or sending wireless signals; and a feed member electrically connected to the first antenna unit and the second antenna unit, wherein the feed member receives wireless signals and transmits the wireless signals through the first antenna, the second antenna unit and the third antenna unit to generate corresponding current paths, and the first antenna unit is located between the second antenna unit and the third antenna unit to isolate the second antenna unit and the third antenna unit to avoid coupling interference of their resonant frequencies; the first antenna unit is capable of generating a low frequency current path and comprises a first radiating member and a second radiating member, the second radiating member is connected to an end of the first radiating member, forming an angle less than 90° with the first radiating member.

* * * * *